US005548658A

United States Patent [19]

Ring et al.

[11] Patent Number: 5,548,658

[45] Date of Patent: Aug. 20, 1996

[54] ACOUSTIC TRANSDUCER

[75] Inventors: Eugene M. Ring, Evanston; William J. Murphy, Carpentersville, both of Ill.

[73] Assignee: Knowles Electronics, Inc., Itasca, Ill.

[21] Appl. No.: 254,583

[22] Filed: Jun. 6, 1994

[51] Int. Cl.[6] ..... H04R 25/00

[52] U.S. Cl. ..... 381/191; 381/174; 367/170

[58] Field of Search ..... 381/191, 173, 381/68, 68.6, 168, 174, 113, 116; 367/169, 170, 173, 174, 181, 188; 310/324, 800

[56] References Cited

U.S. PATENT DOCUMENTS

| | | | |
|---|---|---|---|
| 4,063,050 | 12/1977 | Carlson et al. | 381/191 |
| 4,316,062 | 2/1982 | Beveridge | 179/111 R |
| 4,701,640 | 10/1987 | Flygstad et al. | 381/173 |
| 4,730,283 | 3/1988 | Carlson et al. | 381/191 |
| 4,764,690 | 8/1988 | Murphy et al. | 307/400 |
| 4,815,560 | 3/1989 | Madaffari | 381/68.6 |
| 5,075,991 | 12/1991 | Wenkman et al. | 40/152.1 |

FOREIGN PATENT DOCUMENTS

| | | |
|---|---|---|
| 0533284A1 | 3/1993 | European Pat. Off. . |
| WO93/18627 | 9/1993 | WIPO . |

*Primary Examiner*—Curtis Kuntz
*Assistant Examiner*—Huyen D. Le
*Attorney, Agent, or Firm*—Wallenstein & Wagner, Ltd.

[57] ABSTRACT

An electret assembly for a microphone is disclosed. The microphone is adapted for use with a hearing aid. The electret assembly comprises a motor ring having first and second opposing peripheral surfaces and an aperture extending therebetween. The motor ring includes four generally co-planer ledges recessed below the first opposing surface and defining a rectangle. A charged plate is disposed on the ledges. The charged plate is substantially flush with the first opposing surface. A flexible diaphragm is secured to the second opposing surface and extending across the aperture. A bead of epoxy secures the charged plate to the motor ring.

19 Claims, 2 Drawing Sheets

ACOUSTIC TRANSDUCER

TECHNICAL FIELD

The present invention relates to an acoustic transducer, such as a microphone for a hearing aid, and more particularly to an improved electret assembly construction for maintaining a charged lo plate in spaced relationship with a diaphragm.

BACKGROUND PRIOR ART

As is well known, miniaturized acoustic transducers, such as microphones for hearing aids, typically include a device commonly referred to as a motor, comprising a diaphragm positioned in spaced relation with a charged plate. Various structures have been proposed for maintaining the diaphragm in spaced relation with the charged plate.

One such structure is illustrated in Carlson, et. al., U.S. Pat. No. 4,730,283, which is assigned to the assignee of the present invention. According to this structure, a plurality of bumps are provided on the lower surface of the charged plate, radially inward of the periphery of the charged plate, to maintain the diaphragm in spaced relation with the charged plate. While this structure has operated satisfactorily, the bumps affect the resonant frequency of the diaphragm. Additionally, the bumps affect the capacitance and the sensitivity of the microphone. Although the motor is capacitive, this additional capacitance is parasitic in nature and affects the magnitude of the signal which can be transferred to the microphone amplifier.

The present invention is provided to solve these and other problems.

SUMMARY OF THE INVENTION

It is an object of the invention to provide an electret assembly such as for a microphone for use with a hearing aid.

In accordance with the invention, a motor ring has first and second opposing peripheral surfaces and an aperture extending therebetween. The motor ring includes a plurality of co-planer ledges recessed below the first opposing surface. A charged plate is disposed on the ledges. A flexible diaphragm is secured to the second opposing surface and extends across the aperture. The ledges thereby maintain the position of the charged plate relative to the diaphragm.

The charged plate is substantially flush with the first opposing surface. Additionally, epoxy is provided for securing the charged plate to the motor ring.

It is contemplated that the motor ring includes four of the ledges defining a rectangle, possibly a square.

It is further contemplated to provide a gap between the motor ring and the charged plate.

Other features and advantages of the invention will be apparent from the following specification taken in conjunction with the following drawing.

DETAILED DESCRIPTION

Figure 1:
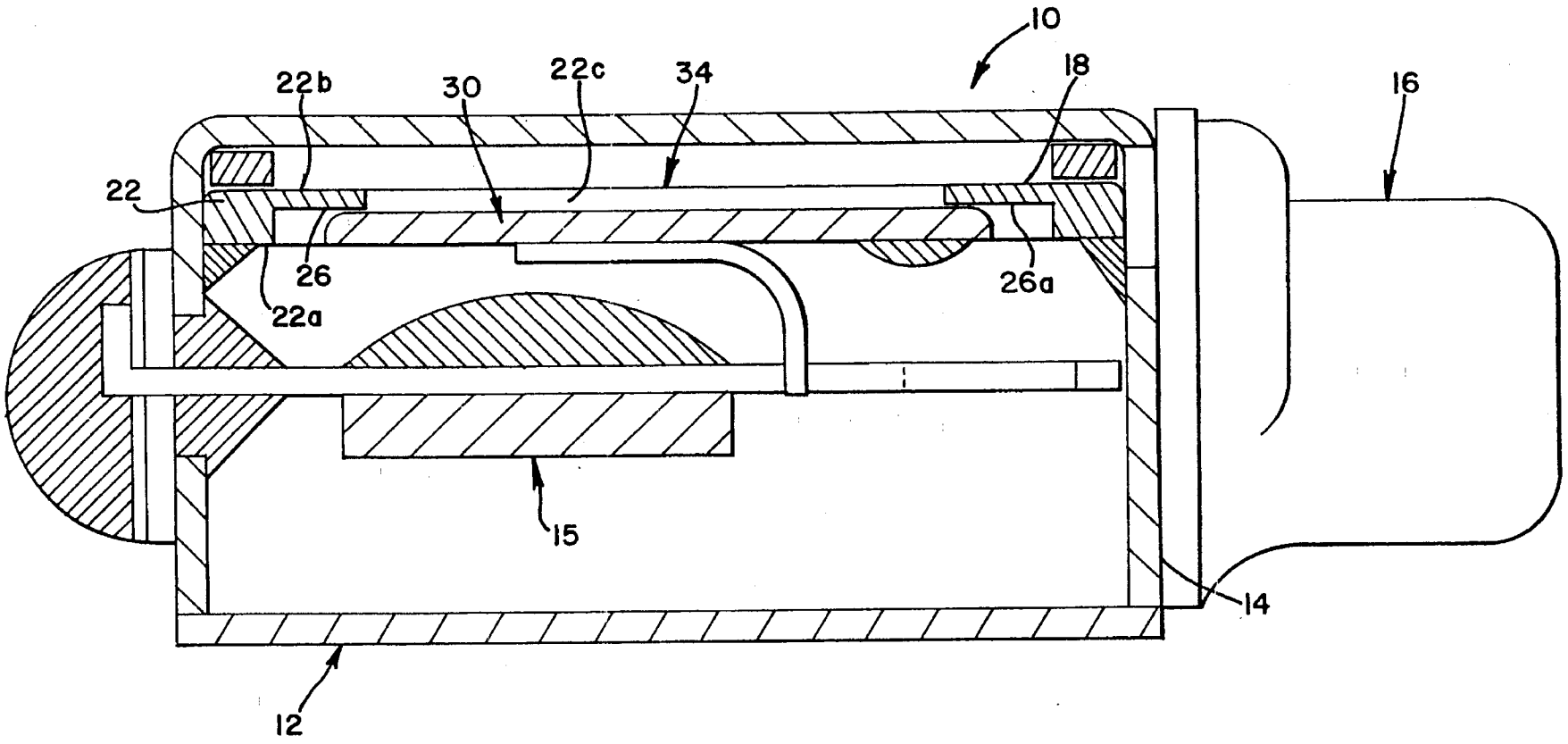
FIG. 1 is a sectional view of a microphone including an electret assembly in accordance with the invention.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

A microphone, generally designated 10, for a hearing aid (not shown) adapted to be disposed within an ear canal is illustrated in FIG. 1. The microphone 10 is disposed within a housing 12 having a housing wall 14. A sound inlet port 16 extends through the housing wall 14. An electret assembly 18 is disposed within the housing 12, as is conventional circuitry 15. But for the electret assembly 18, the microphone 10 is a conventional microphone such as the EK Microphone sold by Knowles Electronics Inc., of Itasca, Ill., the assignee of this invention. A more detailed description of the EK microphone is contained in U.S. Pat. No. 4,730,283, the specification of which is expressly incorporated herein by reference.

Figure 3:
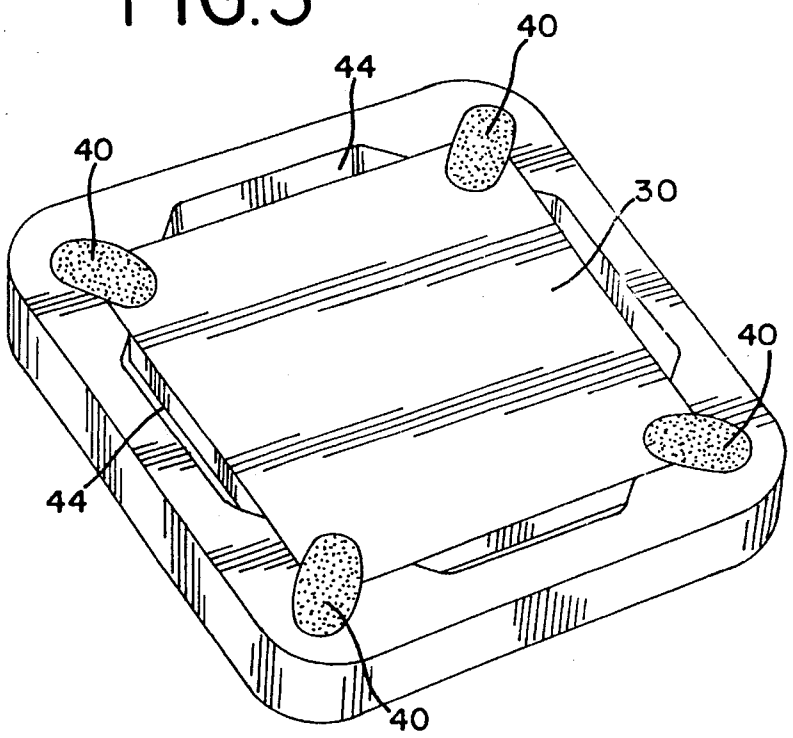
FIG. 3 is a perspective view of the electret assembly of FIG. 1.
Figure 2:
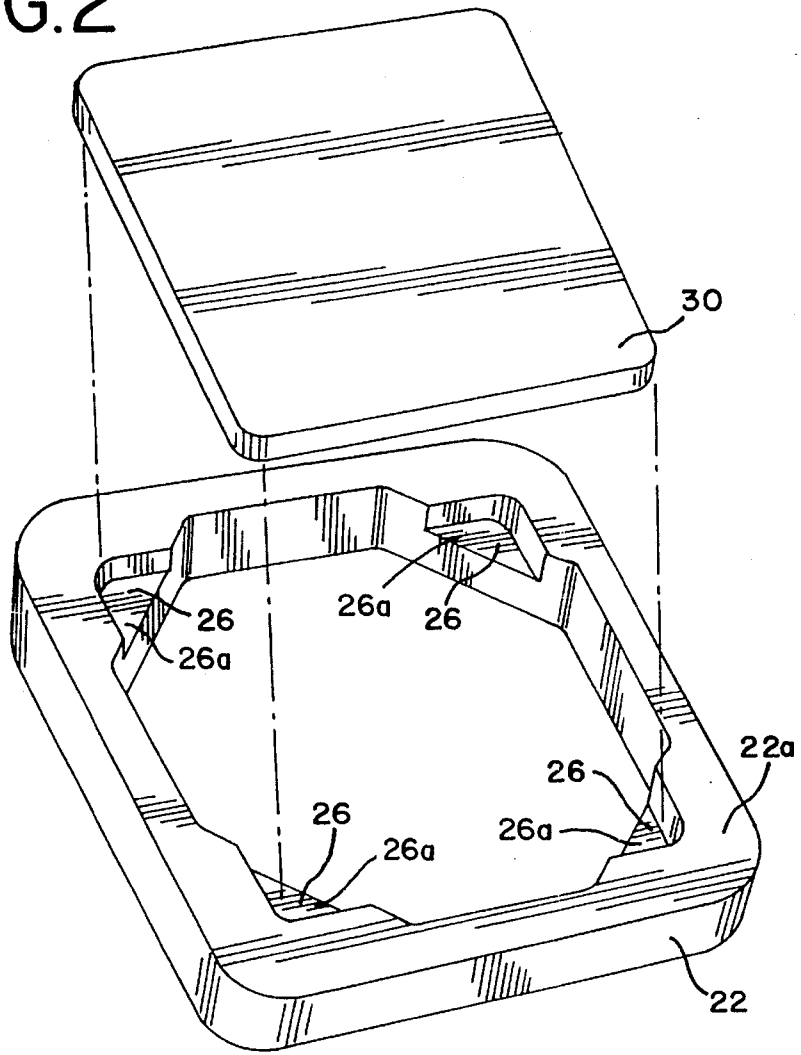
FIG. 2 is an exploded perspective view of the electret assembly of FIG. 1.

As shown in greater detail in FIGS. 2 and 3, the electret assembly 18 includes a motor ring 22 having first and second opposing peripheral surfaces **22*a*, 22*b*, respectively, and a motor aperture 22*c* extending therebetween. The motor ring 22 is formed of brass, approximately 0.005" in thickness, and includes a plurality of co-planer ledges 26 having corresponding co-planer ledge surface 26*a* which are recessed below the first opposing surface 22*a*** by a distance of approximately 0.0033'.

The ledges 26 define a generally rectangular support surface, and are formed by first cutting to form the aperture **22*c*, and then coining the motor ring 22 to form the ledges 26. Excess metal resulting from the coining is then removed from the aperture 22*c***.

A charged plate 30 is disposed on the ledges 26 and a flexible diaphragm 34 (FIG. 1) is secured by epoxy (not shown) to the second opposing surface **22*b* and extends across the aperture 22*c*. The charged plate is conventional, comprising a 0.005" thick stainless steel plate coated with 0.001" thick Teflon. The diaphragm 34** is conventional, comprising 6 gauge metalized (gold coated) Mylar.

As illustrated in FIGS. 1 and 2, the ledge surfaces **26*a* support the charged plate 30 in spaced relationship from the second opposing surface 22*b*, and hence from the diaphragm 34**.

As shown in FIG. 3, the charged plate 30 is substantially flush with the first opposing surface **22*a***.

After placement on the ledges 26, the charged plate is secured to the motor ring 22 by four beads of thickened epoxy 40, each extending between the motor ring 22 and a respective corner of the charged plate 30. As is also conventional, the aperture 22 is formed to result in a gap 44 which extends into the volume between the diaphragm 34 and the charged plate 30. The electret assembly 18 is illustrated as generally square, however, the actual shape can vary, depending upon housing configuration or other acoustic considerations, as is well known.

It will be understood that the invention may be embodied in other specific forms without departing from the spirit or central characteristics thereof. The present example and embodiment, therefore, is to be considered in all respects as illustrative and not restrictive, and the invention is not to be limited to the details given herein.

We claim:

1. An electret assembly comprising:

a motor ring having first and second opposing peripheral surfaces and an aperture extending therebetween, said motor ring including a plurality of co-planer ledges, said ledges having co-planer ledge surfaces being substantially parallel and recessed below said first opposing surface;

a charged plate disposed on said recessed ledge surfaces, said recessed ledge surfaces supporting said charged plate in spaced relationship from said second opposing surface; and a flexible diaphragm secured to said second opposing surface and extending across said aperture.

2. The assembly of claim 1 wherein said charged plate is substantially flush with said first opposing surface.

3. The assembly of claim 1 including means for securing said charged plate to said motor ring.

4. The assembly of claim 3 wherein said securing means comprises a bead of epoxy extending between said motor ring and said charged plate.

5. The assembly of claim 4 including a plurality of said beads of epoxy.

6. The assembly of claim 1 wherein said motor ring includes four of said ledges defining a rectangle.

7. The assembly of claim 6 wherein said rectangle is a square.

8. The assembly of claim 1 including a gap between said motor ring and said charged plate.

9. A microphone for a hearing aid adapted to be disposed within an ear canal, the microphone comprising:

a housing having a housing wall;

a sound inlet port extending through said housing wall;

an electret assembly disposed within said housing, said assembly including a motor ring having first and second opposing peripheral surfaces and an aperture extending therebetween, said motor ring including a plurality of co-planer ledges, said ledges having co-planer ledge surfaces being substantially paralled and recessed below said first opposing surface, a charged plate disposed on said recessed ledge surfaces, said recessed ledge surfaces supporting said charged plate in spaced relationship from said second opposing surface, and a flexible diaphragm secured to said second opposing surface and extending across said aperture.

10. The assembly of claim 9 wherein said charged plate is substantially flush with said first opposing surface.

11. The assembly of claim 9 including means for securing said charged plate to said motor ring.

12. The assembly of claim 11 wherein said securing means comprises a bead of epoxy extending between said motor ring and said charged plate.

13. The assembly of claim 12 including a plurality of said beads of epoxy.

14. The assembly of claim 9 wherein said motor ring includes four of said ledges defining a rectangle.

15. The assembly of claim 14 wherein said rectangle is a square.

16. The assembly of claim 9 including a gap between said motor ring and said charged plate.

17. An electret assembly for a microphone, the microphone adapted for use with an in the ear hearing aid, the electret assembly comprising:

a motor ring having first and second opposing peripheral surfaces and an aperture extending therebetween, said motor ring including four generally co-planer ledges, said ledges having co-planer ledge surfaces being substantially paralled and recessed below said first opposing surface and defining a rectangle;

a charged plate disposed on said recessed ledge surfaces, said recessed ledge surfaces supporting said charged plate in spaced relationship from said second opposing surface, wherein said charged plate is substantially flush with said first opposing surface;

a flexible diaphragm secured to said second opposing surface and extending across said aperture; and means for securing said charged plate to said motor ring.

18. The assembly of claim 17 wherein said securing means comprises a bead of epoxy extending between said motor ring and said charged plate.

19. The assembly of claim 18 including a plurality of said beads of epoxy, one disposed at each of said ledges.

* * * * *